US005765924A

United States Patent [19]

Liesveld

[11] Patent Number: 5,765,924

[45] Date of Patent: Jun. 16, 1998

[54] HIGH PRESSURE WATER JET CHANNELING HORIZONTALLY INTO A SOLID MOUNTAIN OF GRANITE

[76] Inventor: Daniel J. Liesveld, 6016 Newcombe St., Arvada, Colo. 80004

[21] Appl. No.: 652,339

[22] Filed: May 22, 1996

[51] Int. Cl.[6] ..... F21C 25/60

[52] U.S. Cl. ..... 299/15; 239/101; 299/17

[58] Field of Search ..... 299/15, 17; 175/67; 239/101

[56] References Cited

U.S. PATENT DOCUMENTS

| | | | |
|---|---|---|---|
| 4,111,490 | 9/1978 | Liesveld | 299/17 |
| 4,176,883 | 12/1979 | Liesveld | 299/15 X |
| 5,332,293 | 7/1994 | Higgins et al. | 299/15 |

*Primary Examiner*—David J. Bagnell

[57] ABSTRACT

A method and apparatus for horizontal channeling into a mountain of granite automatically have been developed in which a water jet nozzle contained in a rigid lance assembly advances in and out of the mountain to the depth of the lance in a horizontal plane along a line of cut predetermined by the setup of the apparatus and the original drilled hole. The jet oscillates back and forth in a transverse fashion, cleaving the crystal formation of the granite through the application of high pressure water pulsing at the appropriate angle of penetration to achieve the correct spalling of the granite surface in slightly upward direction such that the channel remains free of chips and grit for easy movement of the feed system. The machine advances incrementally just prior to the lance entering the channel, maintaining standoff distances to properly erode channel corners. When the desired length of horizontal cut is reached, the lance is rotated upward ninety degrees, proceeding in and out in an upward motion until the desired height of block is reached. Four sides of the block are relieved in this manner, completing a square pattern which can easily be split out of the mountain. The angle of penetration, speed of oscillation and travel are varied to achieve a maximum efficiency depending on the type of granite that is being cut.

2 Claims, 3 Drawing Sheets

HIGH PRESSURE WATER JET CHANNELING HORIZONTALLY INTO A SOLID MOUNTAIN OF GRANITE

BACKGROUND OF THE INVENTION

1. Field of the Invention

Quarrying, mining, and/or tunneling into a mountain with a horizontal water jet is the field of my invention.

2. Description of the Prior Art

Related Prior Art are as follows:

(1) #4111490, granted Sep. 5, 1978 to Liesveld, titled, "METHOD AND APPARATUS FOR CHANNEL CUTTING OF HARD MATERIALS USING HIGH VELOCITY FLUID JETS", and (2) #4176883, granted Dec. 4, 1979 to Liesveld, titled, "OSCILLATING LIQUID JET SYSTEM AND METHOD FOR CUTTING GRANITE AND THE LIKE", and (3) #5332293, granted Jul. 26, 1994 to Higgins et al, titled, "APPARATUS FOR CUTTING EROSIVE MATERIALS USING HIGH PRESSURE WATER DEVICE".

Summary

It is an object of the invention to generate an improved method of horizontal channeling using an oscillating jet to produce blocks faster, easier, and more efficient predominantly in a mountain setting, although flat land quarries could also benefit from this method as open pits do have walls where there is usable stone. Faster operation is possible because the invention is always concentrating its energies on new stone removal. Easier operation is attained by going directly after the stone a quarrier wants using less labor and handling of overburden. More efficient operation is achieved through fewer nozzle breakdowns due to chip and grit wear.

Another object of the invention is to present a means of going after the stone a quarrier could see before but never go after due to the vertical walls and no cost effective method for going after it. The horizontal process of going into solid walls of granite and quarrying blocks where the stone is good is what the invention is all about.

A further object of the invention is to use the oscillating jet method in a horizontal mode as a major improvement over the vertical mode because of chip and grit free operation. In the vertical mode, chips and grit fall in the bottom of the channel where the jet is cutting, creating wear and additional cutting time, whereas in the horizontal mode, the chips and grit fly in back of the oscillating jet and stay there, saving wear and increasing the cutting rate. The horizontal oscillating jet is always cutting new material and never getting stuck in the old material previously cut.

An additional object of the invention is the way in which the granite is separated from the deposit without disturbing the deposit at all. The horizontal oscillating jet is a concept that does not blast, burn, or deface the granite in any way as the water jet cleaves the individual crystals using the natural structure of the granite to its advantage.

In cutting channels horizontally, the automatic apparatus uses a method of an oscillating jet moving in and out of the channel always proceeding incrementally forward toward the deposit at the appropriate angle of penetration, to cleave out a channel of sufficient width to let the feed system proceed evenly without worry of hitting the jagged edges of the channel, which could, if hit, cause a breakdown of undetermined cost and time. Upon channel completion, the jet is simply turned upward and the process is again repeated in an upward manner, using the same horizontal mode.

The horizontal oscillating jet uses a gentle, automatic method of stone removal to achieve block production that is more cost effective than vertical jet stone removal due to less wear and more concentrated production efforts without heavy labor or waste of stone from unnecessary cracks thrown in by the process.

The invention does produce dimensional stone in an efficient, environmentally safe manner without heavy personal labor due to automatic operation.

DESCRIPTION OF THE PREFERRED EMBODIMENT(S)

Figure 1:
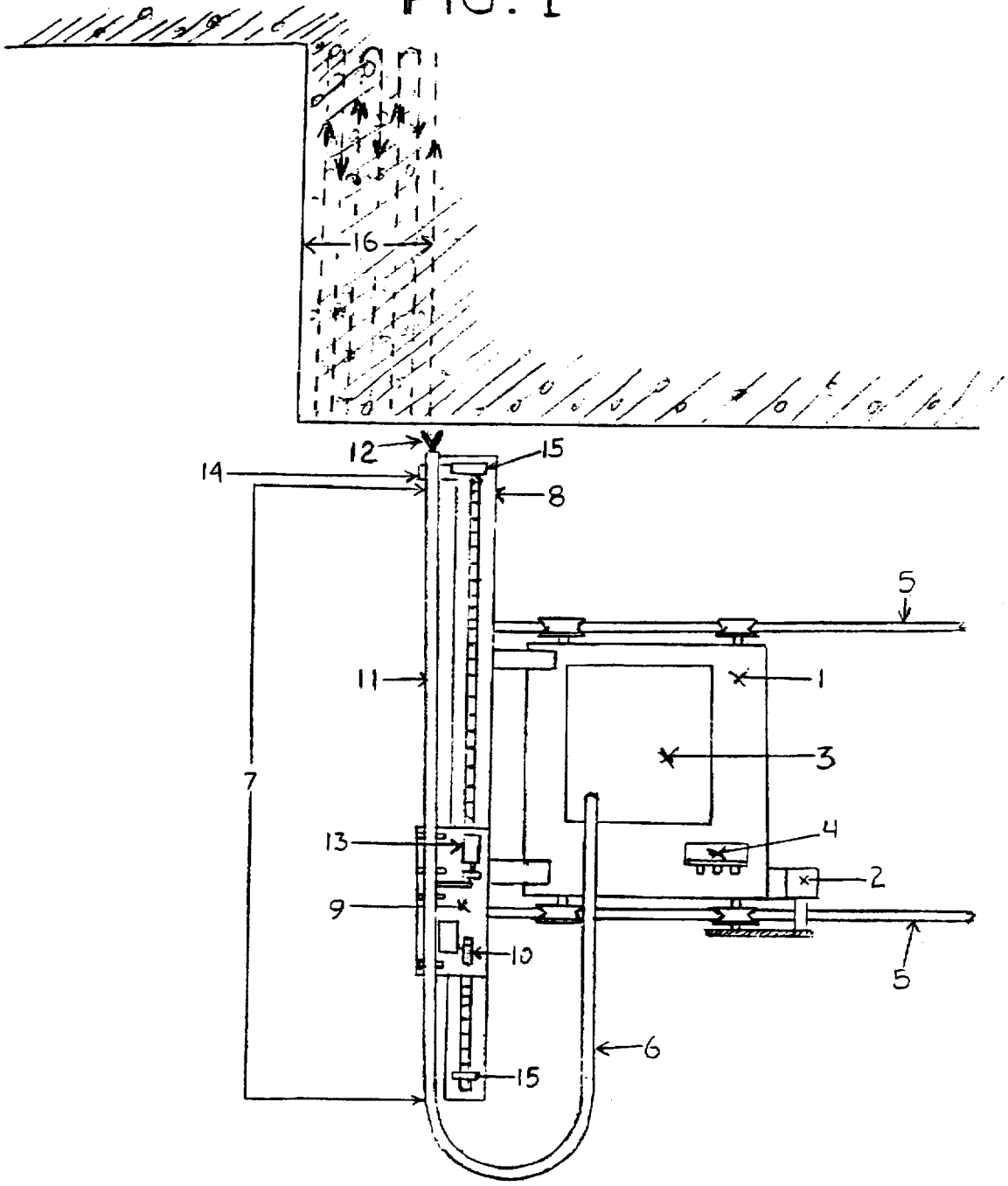
FIG. 1 is a Horizontal channeler plan view
Figure 2:
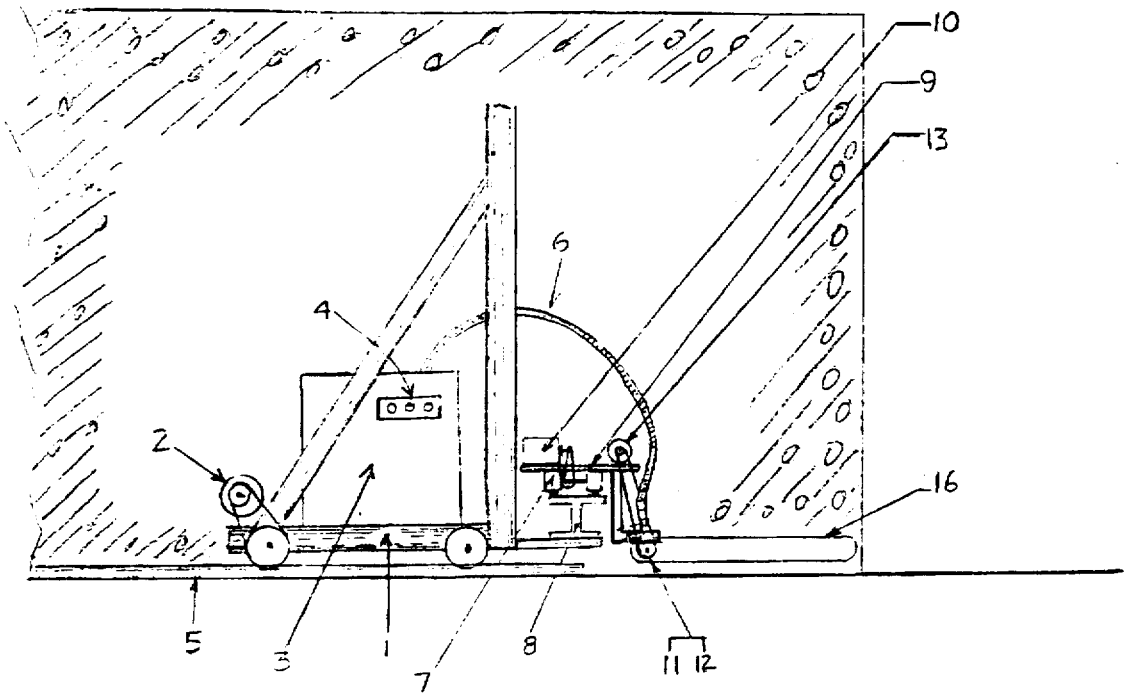
FIG. 2 is a Horizontal Channeler Front View
Figure 3:
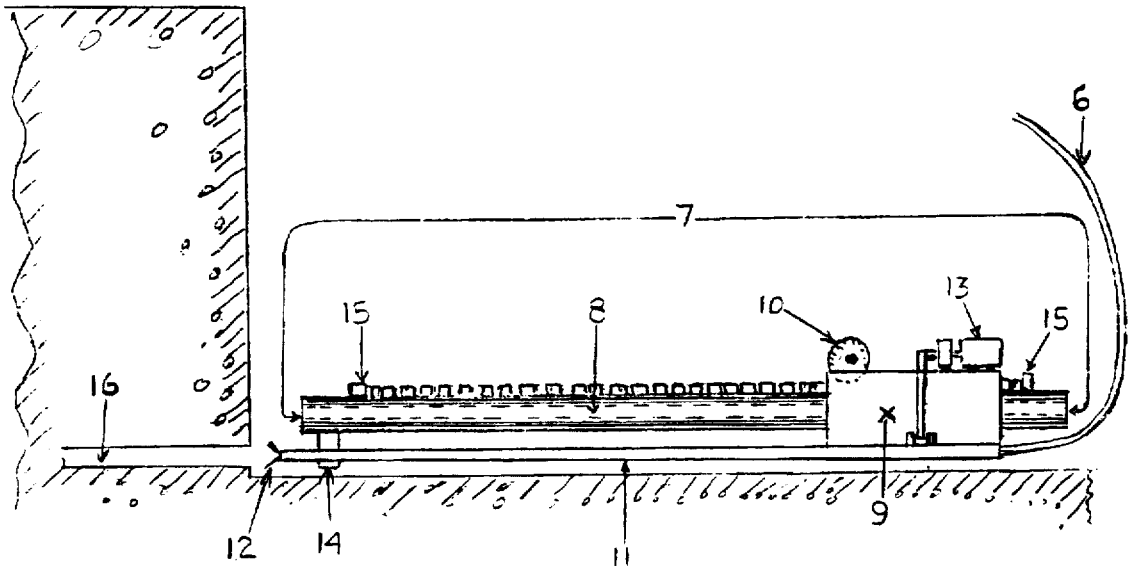
FIG. 3 is a Horizontal Channeler Feed System

This self-contained system to cut horizontally includes: a cart(1) on v-rails(5)using a cart drive motor with chain drive(2), a high pressure intensifier pump(3), capable of 45,000 psi, that supplies the pressure required to cut the granite, the high pressure water is transmitted through a high pressure water supply line(6), a carriage(9) that carries the lance (11), which carries the water to the nozzle(12) with a sapphire orifice, a carriage motor (10) with a drive gear that engages the pinion gear rack held up by an I-beam(8), an oscillating motor(13) and cam that oscillates the nozzle(12), transversely to the line of the lance(11), a feed system(7) that moves the carriage(9), lance(11) and nozzle(12) in and out on a guide(14) by means of reversing limit switches(15), and a control system (4)that directs all the functions.

The method in which the previously described apparatus is used is as follows:

first drill a 3 inch round hole back 12 feet. Set the cart(1) in position on the V-rail(5). Insert the lance(11) and its nozzle (12) into the hole at the back. Pressurize the intensifier(3) up to 45,000 psi and start the oscillator motor with cam(13). Back the lance(11)out of the hole with the oscillator(13) running and fully pressurized. The channel(16) is 2½" wide and is eroded ¼ inch. The cart(1) moves forward ¼ inch and the lance(11) moves back into the hole for another 12 feet of erosion. Another ¼ inch of channel(16) is removed. This is repeated until you have a channel of desired length. The width of the channel(16) is 2 and ½ inches and depth is 12 feet. Thus you have a horizontal channel(16) cut with a series of ¼ inch increments. To channel upwards for a wall, the nozzle is rotated 90 degrees to cut upwards. The feed system(7) is still horizontal, but is now raised in ¼ increments by two screw driven masts mounted on the cart(1). The cart(1) does not move when cutting up. The high pressure jet stream is less than a thin needle in thickness. When moved across the granite it cuts a slot 1/16 inch wide and ¼ inch deep. So how does it manage to erode a clear channel(16) 2 and ½ inches wide? The answer is cavitation of the water and the structure of the granite. Granite is composed of many crystals all fused together by intense heat and pressure. Each crystal is angular with many sides and planing throughout. The jet stream is composed of plain water and has the speed and force of a bullet.

It will bottom out at ¼ inch. Because water will not compress, it starts cavitating. This cavitating action blasts out the webbing that was standing between the zig zag kerfs of the oscillating nozzle. Whole crystals and parts of crystals don't have a chance. Jet(3) pressure is 45,000 psi and the granite is 25,000 psi. We can cut out single blocks or big sections of blocks.

What is claimed is:

1. A method of automated channeling into a vertical face of granite horizontally comprising the steps of:

(a) directing a high pressure jet horizontally at a wall of granite that is first penetrated by a pre-drilled hole;

(b) driving the jet into and out of the wall starting in the pre-drilled hole, oscillating the jet traversely to the direction of impingement on the granite, forming a channel width sufficient for jet feed movement;

(c) indexing forward in a direction parallel to the granite wall to complete a square channel of predetermined length perpendicular to the face;

(d) rotating the jet upwardly ninety degrees, utilizing jet oscillation, penetrating inward, retracting outward and indexing upward to cut a vertical channel in a into the granite;

(e) repeating steps (c) and (d) to form a second square channel and a second vertical channel, creating a square block, and (f) splitting out the square block of granite.

2. Apparatus for automatic horizontal channeling into a vertical face of granite, comprising:

a horizontal jet for delivering a high pressure stream of water pulsing toward the granite at high speed, cleaving granite crystals, separating the granite at the point of impingement, and expelling granules out of the jet's way;

a variable speed oscillating system that moves the jet in a transverse motion to the angle of impingement to produce a jetting action for cutting;

a variable speed drive system that will drive the jet into and out of the granite;

a variable speed indexing system that will incrementally act in a parallel manner to provide a standoff distance for optimum channel width for jet movement;

a feed system for holding and protecting the oscillating system and transmitting energy to the jet; and an I beam structure for movably supporting the drive system.

* * * * *